US008596232B1

(12) United States Patent
Yashirodai et al.

(10) Patent No.: US 8,596,232 B1
(45) Date of Patent: Dec. 3, 2013

(54) TWO-STROKE CYCLE ENGINE

(75) Inventors: Tadao Yashirodai, Kakogawa (JP); Masanobu Tanaka, Kobe (JP); Akihito Shimizu, Kobe (JP); Katsumi Kinoshita, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 13/562,155

(22) Filed: Jul. 30, 2012

(51) Int. Cl.
*F01L 3/20* (2006.01)
*F01L 5/06* (2006.01)
*F02B 25/00* (2006.01)

(52) U.S. Cl.
USPC ..... 123/65 V; 123/65 VA; 123/65 P

(58) Field of Classification Search
USPC ..... 123/65 V, 65 VA, 65 P
See application file for complete search history.

(56) References Cited

U.S. PATENT DOCUMENTS

| | | | | |
|---|---|---|---|---|
| 2,115,180 | A * | 4/1938 | Schneider | 123/65 BA |
| 4,706,617 | A * | 11/1987 | Asai et al. | 123/65 PE |
| 6,079,379 | A * | 6/2000 | Cobb, Jr. | 123/73 B |
| 6,267,088 | B1 * | 7/2001 | Rosskamp et al. | 123/73 PP |
| 6,289,469 | B1 * | 9/2001 | Sakata et al. | 713/600 |
| 6,418,891 | B2 | 7/2002 | Kobayashi | |
| 6,978,744 | B2 | 12/2005 | Yuasa et al. | |
| 7,089,891 | B2 | 8/2006 | Yuasa et al. | |
| 2001/0020454 | A1 * | 9/2001 | Kobayashi | 123/73 A |
| 2002/0043227 | A1 * | 4/2002 | Carlsson et al. | 123/73 PP |
| 2004/0244738 | A1 | 12/2004 | Yuasa et al. | |
| 2004/0255883 | A1 | 12/2004 | Yuasa et al. | |
| 2006/0169225 | A1 * | 8/2006 | Carlsson et al. | 123/73 V |

FOREIGN PATENT DOCUMENTS

| | | |
|---|---|---|
| JP | 2001-295652 | 10/2001 |
| JP | 2001-317361 | 11/2001 |
| JP | 2001-317362 | 11/2001 |
| JP | 2004-360656 | 12/2004 |

OTHER PUBLICATIONS

Japanese Application No. 2010-009847 Office Action dated Jul. 2, 2013, 6 pages w/English translation.

* cited by examiner

*Primary Examiner* — Lindsay Low
*Assistant Examiner* — Charles Brauch

(57) ABSTRACT

A two-stroke cycle engine for introducing a air/fuel mixture and an air from a scavenging passage into a combustion chamber includes a valve body for adjusting the opening of an air supply passage, through which the air is supplied to the scavenging passage, and a second opening of a air/fuel mixture supply passage, through which the air/fuel mixture is supplied to the scavenging passage, a check valve for preventing the air within the air supply passage from flowing in a reverse direction, and a delay member projecting into the air supply passage on an upstream side of the check valve for delaying the timing at which the air reaches from the valve body to the air scavenging passage.

13 Claims, 6 Drawing Sheets

TWO-STROKE CYCLE ENGINE

BACKGROUND OF THE INVENTION

1. Field of the Invention

The present invention relates to a two-stroke cycle engine of a scavenging type that is used as a drive source in a small sized work machine such as, for example, a brush cutter.

2. Description of Related Art

The two-stroke cycle engine of air scavenging type has hitherto been known, in which during the scavenging stroke air for leading scavenging is supplied into a combustion chamber after it has been temporarily introduced into a front end portion of a scavenging passage. In this respect, see the JP Laid-open Patent Publication No. 2004-360656. According to this known engine, during the idling, in order to secure a stable rotation, an air supply valve body in an air supply passage is closed to permit only the air/fuel mixture from an air/fuel mixture supply passage to flow into the crank chamber so that the air/fuel mixture of a concentration optimum to the idling may be supplied from the scavenging passage into the combustion chamber.

It has, however, been found that in the known engine of the type discussed above, if the throttle valve is fully opened at a stretch from the idling condition to permit the engine to be rapidly accelerated, not only the air/fuel mixture supply passage but also the air supply passage is opened rapidly. At this time, whereas the air/fuel mixture flows into the combustion chamber from the air/fuel mixture supply passage through the crank chamber and the scavenging passage, the air flows into the combustion chamber from the scavenging passage without flowing through the crank chamber. In addition, since the air supply passage is closed and empty during the idling, a substantial amount of air is rapidly introduced from the air supply passage into the combustion chamber through the scavenging passage.

As a result, the substantial amount of air flows into the combustion chamber earlier than the air/fuel mixture and, therefore, the air/fuel mixture is diluted to become instantly excessively thinned. Accordingly, at the time transfer from the idling condition to the rapid acceleration is initiated, the air/fuel mixture of a concentration required to accomplish the rapid acceleration fails to be supplied into the combustion chamber and, hence, it is quite often that the failure to accelerate and/or the failure of the engine to rotate is/are easy to occur.

In view of the above, it may be contemplated to preset the air/fuel mixture required during the idling to be enriched, but the enrichment of the air/fuel mixture leads to the necessity of increasing the idling opening of the throttle valve and the air supply valve body is correspondingly necessarily opened. Then the supply of the substantial amount of air into the combustion chamber results in an instability of combustion, accompanied by the fluctuation of the rotation. Also, where a lift up type starter operating mechanism is employed, the lift amount during the starting is reduced by a quantity corresponding to the increase of the idling opening and, therefore, the air/fuel mixture required during the starting will not be sufficiently enriched, resulting in a reduction in startability.

Where the drive is made with the throttle valve set to a medium opening, since the passage sectional area of the air supply passage downstream of the throttle valve is large relative to an air supply passage hole in the throttle valve, a flow region, in which the air does not flow within the air supply passage, emerges and, therefore, a turbulent flow of the air tends to easily occur immediately after the flow from the air supply passage hole in the throttle valve into the air supply passage and the flow of the air becomes instable because of that turbulent flow, with the engine rotation consequently becoming unstable.

DISCLOSURE OF THE INVENTION

In view of the foregoing, the present invention is intended to provide a two-stroke cycle engine of a stratified scavenging type, in which transfer from the idling to the rapid acceleration can be carried out stably.

In order to accomplish the foregoing object, the present invention provides a two-stroke cycle engine of a stratified scavenging type, in which a air/fuel mixture and an air are introduced from a scavenging passage into a combustion chamber. This two-stroke cycle engine includes a valve body for adjusting a first opening of an air supply passage, through which the air is supplied to the scavenging passage, and a second opening of a air/fuel mixture supply passage, through which the air/fuel mixture is supplied to the scavenging passage, a check valve for preventing the air within the air supply passage from flowing in a reverse direction, and a delay member projecting into the air supply passage on an upstream side of the check valve for delaying the timing at which the air reaches from the valve body to the air scavenging passage.

According to the present invention, while in the event of the operation taking place to change from an idling condition to a rapid acceleration, a large amount of air flows from the valve body into the air supply passage, which is then empty during the idling, this air is deflected in its direction of flow by the delay member, which projects at a site on an upstream side of the check valve in the air supply valve, and, at the same time, the passage length of this air supply passage from the valve body to the scavenging passage is increased. For this reason, the timing at which the air having flown through the air supply passage flows into the scavenging passage is delayed and approaches the timing at which the air/fuel mixture flows in from the air/fuel mixture passage into the scavenging passage through a crank chamber. Accordingly, it is possible to avoid the occurrence of the failure of the engine to rotate or the failure of the engine to accelerate as a result of an excessive leaning of the air/fuel mixture by the air entering from the scavenging passage into the combustion chamber, allowing the engine to smoothly and rapidly accelerate. This effect of increasing the rapid accelerating capability is accomplished with a simplified structure, in which the delay member is merely provided within the air supply passage.

In a preferred embodiment of the present invention, the delay member may be an upright wall extending along a plane substantially perpendicular to the direction of flow of the air supply passage. The use of the delay member in the form of the upright wall makes it possible for the air within the air supply passage to be deflected in its direction of flow so as to flow over the upright wall extending along the plane substantially perpendicular to the direction of flow and, therefore, the flow of the air can be effectively decelerated and then delayed.

The upright wall referred to above is preferably provided at a location adjacent the check valve and remote from a position intermediate between the valve body and the check valve. Since the upright wall serves to disturb the air flow to increase the flow resistance, positioning of the upright wall at the location adjacent the check valve is effective to suppress the increase of the flow resistance.

In another preferred embodiment of the present invention, a recess forming a part of a flow path for the air may be formed at a site where it confronts a projecting end portion of the upright wall in the air supply passage. While the air within the air supply passage flows over the projecting end portion of the upright wall and is deflected in its direction of flow, the use of the recess makes it possible to secure a flow path necessary to smoothen the air, which has been deflected in its direction of flow, to thereby suppress the undesirable increase of the flow resistance.

The recess referred to above is preferably of a substantially square shape in its transverse sectional shape, in which case the passage area at a site, where the upright wall exists, is chosen to be the substantially same as the passage area on an upstream side in close vicinity of the upright wall. By so setting the passage area, the undesirable increase of the flow resistance brought about by the presence of the upright wall can be suppressed. Also, if the recess referred to above has a substantially square shape as described above, the height and the width of the flow path having the required passage area can be reduced, as compared with those in the case of the use of the round shaped recess, and, therefore, the recess can be easily formed in the limited space available around the air supply passage.

Where the check valve referred to above is employed in the form of a reed valve, the upright wall is preferably disposed at a location adjacent a tip end portion of the reed valve in a transverse section of the air supply passage. This structural feature is advantageous in that since the upright wall is disposed at a location where the impingement of the air upon the tip end portion of the reed valve, on which the highest valve opening pressure acts, is prevented, the timing at which the check valve is opened by the air flowing in the air supply passage is delayed, allowing the timing, at which the air reaches the scavenging passage, to be further delayed.

In a further preferred embodiment of the present invention, the valve body may be a rotary valve of a type, in which a radially extending passage hole is formed in a cylindrical column, in which case the delay member includes a partition plate having a front edge, which extends parallel to an axis of the rotary valve, and extending in a direction conforming to the flow direction of the air supply passage. By so designing, when the rotary valve is fully opened, the flow velocity is lowered as a result of the impingement of the air upon the front edge of the partition plate and, therefore, the timing at which the air flows into the scavenging passage is delayed to permit the smooth rapid acceleration to be accomplished.

Also, since the rotary valve opens so that the air supply passage hole may open gradually largely in a peripheral direction relative to the air supply passage on the downstream side, if no partition plate is employed the air supply passage abruptly enlarges at the downstream side of the air supply passage hole up until the medium opening and, therefore, a strong turbulent flow is likely to occur at that portion. At this time, since by the effect of the partition plate, up until the medium opening (medium load) only one of the flow regions with the air supply passage hole portioned by the partition plate, the abrupt enlargement of the air supply passage is substantially suppressed. As a result, the possibility that the rotation may fluctuate as a result of the occurrence of the strong turbulent flow of the air after it has flown from the air supply passage hole of the rotary valve into the air supply passage is avoided and, from this aspect of view, the stability of the engine rotation is increased.

In a still further preferred embodiment of the present invention, the partition plate may extend from an outlet of the rotary valve to a location downstream of a intermediate position between the outlet and the check valve. According to this structural feature, since the air flowing into one or both of the flow regions in the air supply passage partitioned by the partition plate flows to a location adjacent the check valve while being rectified within the flow regions, the occurrence of the turbulent flow of the air can further assuredly be avoided.

In a yet further preferred embodiment of the present invention, a portioning unit made up of the partition plate and a cylindrical holding member may be substantially coaxially engaged in the air supply passage, in which case the partition plate is formed integrally with the holding member and traverses a hollow of the holding member. In general, the air supply passage and the air/fuel mixture supply passage are provided in the insulator, which functions as a spacer for thermally insulating from the cylinder, which is high in temperature, to the carburetor, and this insulator is made of a raw material of a kind capable of providing a high thermal insulating effect such as, for example, a phenol resin. In view of the fact that the phenol resin is so fragile that the integral formation of the partition plate is difficult to achieve. In contrast thereto, if the partitioning unit made up of the partition plate and the holding member is employed, the partitioning unit can be formed with the use of a resin excellent in molding capability such as, for example, nylon and, therefore, with this partitioning unit mounted in the air supply passage, the partition plate can be easily and rigidly fitted to the air supply passage.

In the practice of the present invention, it is preferred to employ the previously described upright wall and the previously described partition plate provided on an upstream side of the upright wall. By so doing, not only can the rapid accelerating capability can be increased by the use of the upright wall and the partition plate, but also the stability of the rotation of the engine during the medium opening drive can be increased with the use of the partition plate.

Any combination of at least two constructions, disclosed in the appended claims and/or the specification and/or the accompanying drawings should be construed as included within the scope of the present invention. In particular, any combination of two or more of the appended claims should be equally construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF PREFERRED EMBODIMENTS

Preferred embodiments of the present invention will now be described in detail with reference to the accompanying drawings.

Figure 1:
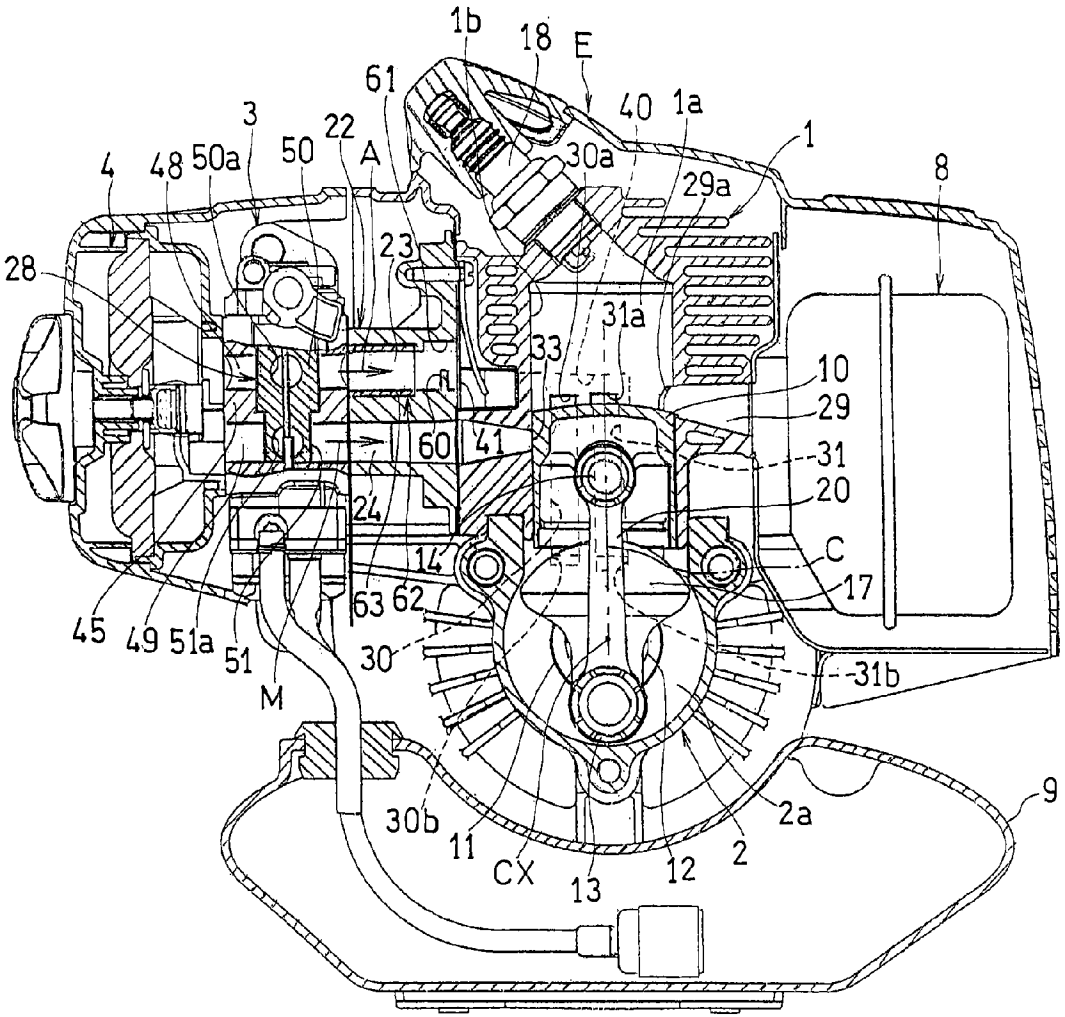
FIG. 1 is a transverse sectional view showing a two-stroke cycle engine of a stratified scavenging type designed in accordance with a first preferred embodiment of the present invention, which engine is viewed from front.

A two-stroke cycle engine, illustrated in FIG. 1, includes a cylinder block 1 mounted rigidly on a crankcase 2 with a combustion chamber 1*a* defined within he cylinder block 1. The cylinder block 1 cooperate with the crankcase 2 to define an engine main body E. A carburetor 3 and an air cleaner unit 4, both forming respective parts of an air intake system of the engine are connected with one side portion, specifically a left side portion as viewed in FIG. 1, of the cylinder block 1, and a muffler 8, forming a part of an exhaust system of the engine, is connected with the opposite side portion, that is, a right side portion as viewed in FIG. 1, of the engine block 1. A fuel tank 9 is fitted to a lower portion of the crankcase 2.

The cylinder block 1 referred to above has a cylinder bore 1*b* defined therein and a hollow reciprocating piston 10 is accommodated within the cylinder bore 1*b* for reciprocal movement in a direction aligned with the longitudinal axis C of such cylinder block 1. The crankcase 2 referred to above includes a crankshaft 12 supported therein by means of bearing members 11. The crankshaft 12 is provided with a hollow crank pin 13 mounted thereon and is held at a position displaced from the longitudinal axis CX of the crankshaft 12. This crank pin 13 and a hollow reciprocating piston pin 14 provided on the piston 10 are drivingly connected with each other through a connecting rod 20. The crankshaft 12 is provided with a pair of crank webs 17 for movement together therewith, and an ignition plug 18 is mounted atop the cylinder block.

An insulator 22, which is due to serve as a spacer, is interposed between the cylinder block 1 and the carburetor 3 for the purpose of thermally protecting the carburetor 3 from the cylinder block 1 tending to evolve a high temperature heat during the operation of the engine. This insulator 22 is of a structure, in which a downstream portion of an air supply passage 23 is formed in an upper side of such insulator and a similarly downstream portion of an air/fuel mixture supply passage 24 is formed in a lower side of such insulator 22 so as to extend parallel to the downstream portion of the air supply passage 23. The carburetor 3 referred to previously is operable to adjust respective passage areas of the air supply passage 23 and the air/fuel mixture supply passage 24 by means of a single rotary valve (rotational valve) 28. The rotary valve 28 is of one piece structure including an air supply valve body 50 and an air/fuel mixture supply valve body 51. The rotary valve 28 has therein an air supply passage hole 50*a* and an air/fuel mixture supply passage hole 51*a*, each of which is in the form of a round hole extending completely through the rotary valve 28 in a radial direction.

Figure 2:
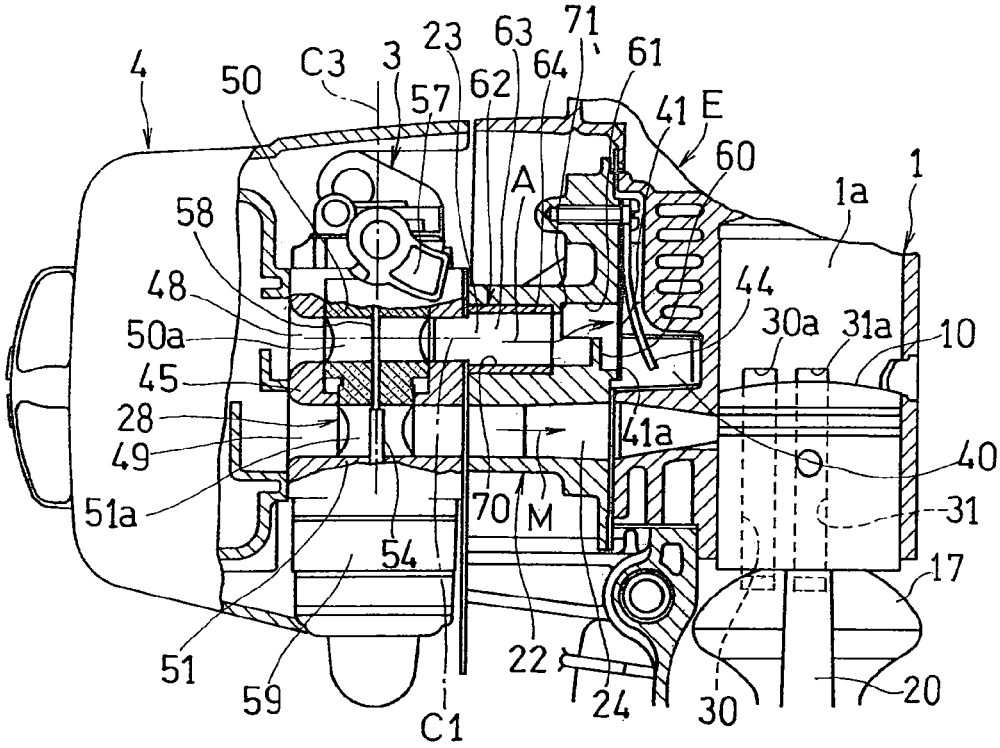
FIG. 2 is a fragmentary transverse sectional view showing, with a portion cut out, an important portion of the two-stroke cycle engine shown in FIG. 2.

The carburetor 3 has a carburetor body 45, in which a carburetor air supply passage 48, through which a scavenging air A is supplied towards the engine main body E, and a carburetor air/fuel mixture supply passage 49, through which the air/fuel mixture M is supplied towards the engine main body E, are formed so as to extend therethrough in substantially parallel relation to each other. Also, as shown in FIG. 2, the single rotary valve 28 extending through and lying substantially perpendicular to the supply passages 48 and 49 is pivotally supported in the carburetor body 45. The air supply valve body 50 and an air/fuel mixture supply valve body 51 formed by the rotary valve 28 are pivotable about an axis C3 extending in an up and down direction and substantially perpendicular to the air supply passage hole 50*a* and the air/fuel mixture supply passage 51*a* to thereby adjust the respective opening of those supply passages 48 and 49. The carburetor air supply passage 48 and the air supply passage hole 50*a* altogether form an upstream portion of the air supply passage 23 whereas the carburetor air/fuel mixture supply passage 49 and the air/fuel mixture supply passage hole 51*a* altogether form an upstream portion of the air/fuel mixture supply passage 24.

Also, the cylinder block 1 has a peripheral wall having an exhaust passage 29 defined therein, which passage 29 has an exhaust port 29*a* open at an inner peripheral surface of such peripheral wall of the cylinder block 1 so that exhaust gases (combustion gases) flowing from the exhaust passage 29 can be discharged to the outside through the muffler 8.

The cylinder block 1 and the crankcase 2 have defined therein first and second scavenging passages 30 and 31 that communicate directly between the combustion chamber 1*a* and a crank chamber 2*a*, which are positioned one above the other and on respective sides of the reciprocating piston 10. The first and second scavenging passages 30 and 31 have respective first and second scavenging ports 30*a* and 31*a* defined at upper ends thereof so as to open at the inner peripheral surface of the cylinder block 1 and also have respective inflow port 30*b* and 31*b* defined at lower ends thereof so as to open at an upper portion of an inner peripheral surface of the crankcase 2. The second scavenging passage 31 is formed at a location adjacent the exhaust port 29*a* and remote from the first scavenging passage 30.

The first scavenging port 30*a* at the upper end of the first scavenging passage 30 and the second scavenging port 31*a* at the upper end of the second scavenging passage 31 have respective upper ends held at a position lower than an upper end of the exhaust port 29*a*. Accordingly, during the scavenging stroke with the reciprocating piston 10 descending within the cylinder bore 1*b*, the exhaust port 29*a* is opened prior to respective openings of the first and second scavenging ports 30*a* and 31*a* to allow the combustion gases within the combustion chamber 1A to be discharged into the exhaust passage 29. The air supply passage 23 in the insulator 22 is communicated with respective upper portions of the first and second scavenging passages 30 and 31 through an air introducing passage 40 defined in the cylinder block 1.

Figure 5:
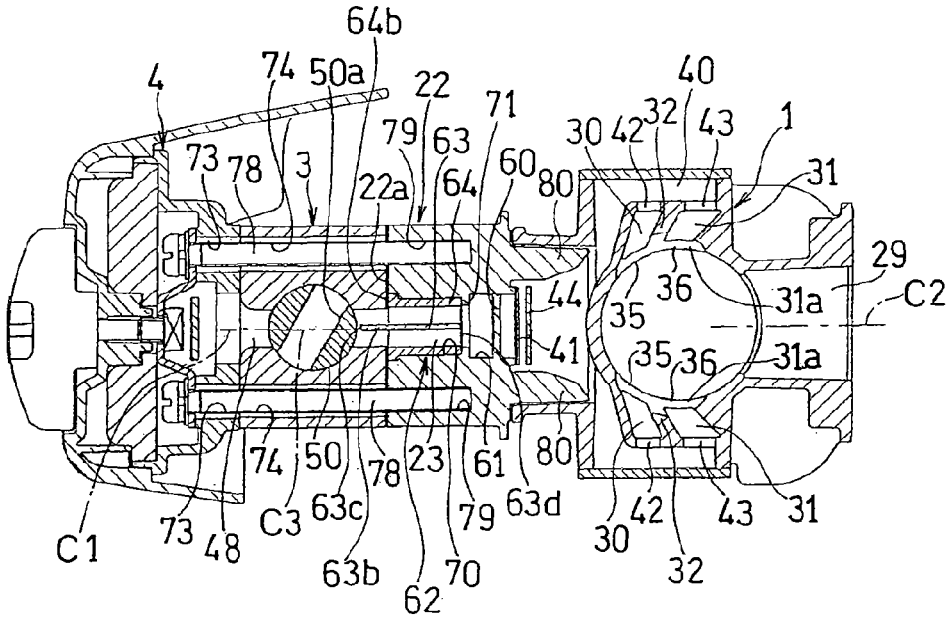
FIG. 5 is a transverse sectional view showing the idling condition of an air intake system of the two-stroke cycle engine as viewed from top.
Figure 6:
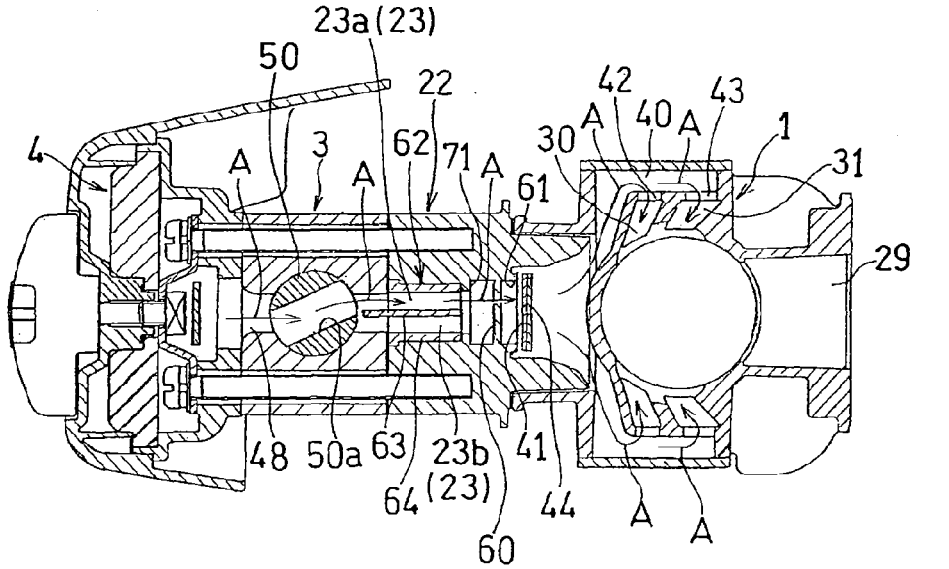
FIG. 6 is a transverse sectional view showing a medium opening drive condition of the air intake system of the two-stroke cycle engine as viewed from top.

As shown in a transverse sectional view in FIG. 5 with the engine viewed from above, a downstream outlet of the air supply passage 23 in the insulator 22 referred to previously is provided with a reed valve 41 operable to close the air supply passage 23 when a negative pressure is developed inside the air introducing passage 40 in response to a negative pressure inside the crank chamber 2*a*, best shown in FIG. 1, during the suction stroke. Also, the air introducing passage 40 and the first and second scavenging passages 30 and 31 are communicated with each other through first and second air introducing ports 42 and 43 provided radially outwardly of respective upper portions of those first and second scavenging passages 30 and 31, respectively. The reed valve 41 referred to above is provided with a stopper 44 for regulating an open position of the reed valve 41. As shown in FIG. 6, the scavenging air A from the air supply passage 23 is introduced from the air introducing passage 40 into the respective upper portions of the first and second scavenging passages 30 and 31 through the first and second air introducing ports 42 and 43.

Each of the air supply passage 23 and the exhaust passage 29 shown in FIG. 5 is straight and those passages 23 and 29 lie on the substantially same line, when viewed from the longitudinal axis C, best shown in FIG. 1, of the cylinder block 1, and each of the first and second scavenging passages 30 and 31 is provided in pair. Specifically the pair of the first scavenging passage 30 are disposed on respective sides of the longitudinal axis C1 of the air supply passage 23 or the longitudinal axis C2 of the exhaust passage 29 in substantially symmetrical relation to each other while the pair of the second scavenging passage 30 are similarly disposed on respective sides of the longitudinal axis C1 of the air supply passage 23 or the longitudinal axis C2 of the exhaust passage 29 in substantially symmetrical relation to each other. Respective cylinder block inner diametric sides of the first and second scavenging passages 30 and 31 are covered respectively by first and second scavenging passage walls 35 and 36.

The scavenging air A from the air supply passage 23 in the insulator 22 best shown in FIG. 1 is temporarily introduced into the first and second scavenging passages 30 and 31 through the air introducing passage 40 in the cylinder block 1 when the reed valve 41 is opened during the suction stroke, during which the reciprocating piston 10 ascends within the cylinder bore 1*b*, in response to the negative pressure developed inside the crank chamber 2*a*. On the other hand, the air/fuel mixture M from the air/fuel mixture supply passage 24 is, when the reciprocating piston 10 ascends during the suction stroke, introduced directly from a mixture supply port 33, defined in the inner peripheral surface of the cylinder block 1, into the crank chamber 2*a* in response to the negative pressure developed inside the crank chamber 2*a*.

The air A so introduced from the air supply passage 23 into the upper portions of the first and second scavenging passages 30 and 31 through the air introducing passage 40 during the suction stroke is jetted from the first and second scavenging ports 30*a* and 30*b* into the combustion chamber in a direction slantwise upwardly during the scavenging stroke, during which the reciprocating piston 10 descends. Subsequently, the air/fuel mixture M introduced into the lower portions of the first and second scavenging passages 30 and 31 through the crank chamber 2*a* is jetted from the first and second scavenging ports 30*a* and 31*a* into the combustion chamber 1*a* in a direction slantwise upwardly while pushing the air in the upper portions of the first and second scavenging passages 30 and 31. In this way, during the scavenging stroke, following the air A the air/fuel mixture M is jetted in a stratified fashion into the combustion chamber 1*a*. Since after the combustion gases have been pushed by the air A, jetted into the combustion chamber 1*a* prior to the air/fuel mixture M, into the exhaust passage 29, the air/fuel mixture M is jetted into the combustion chamber 1*a*, a blow-off phenomenon, in which the air/fuel mixture M leaks to the outside from the scavenging passage 29, can be effectively suppressed.

The carburetor body 45 of the carburetor 3 best shown in FIG. 2 is provided with a main nozzle 54 for a fuel (gasoline), which extends through the bottom of the air/fuel mixture supply valve body 51 in a direction coaxial with the axis C3 and then projects into the interior of the air/fuel mixture supply passage hole 51*a*, and a fuel injection port (not shown) is defined in a portion of a peripheral wall of this main nozzle 54. On the other hand, a needle valve 58 is disposed coaxially with the main nozzle 54, which valve 58 is supported by an upper end portion of the carburetor 3 for movement up and down and extends completely through the air supply passage hole 50*a* to the air/fuel mixture supply passage hole 51*a*, and this needle valve 58 has a lower end portion inserted into the main nozzle 54. A fuel reservoir body 59 having a diaphragm (not shown) built therein is coupled with a lower portion of the carburetor body 45 and the fuel is supplied from this fuel reservoir body 59 to the main nozzle 54.

The rotary valve 28 pivots, when the known throttle valve (not shown) is manually operated, so that the carburetor air supply passage 48 and the carburetor air/fuel mixture supply passage 49 may be set to respective large openings, and simultaneously therewith the needle valve 58 elevates to increase the opening area of the fuel injection port of the main nozzle 54 with a substantial amount of fuel consequently supplied to the carburetor air/fuel mixture supply passage 49. In this way, the rotation of the engine is controlled in response to the operation of the throttle lever.

At the time of start of the engine, a lift-up lever 57 provided on an upper portion of the carburetor 3 is manually rotated an angle of 90° to cause the needle valve 48 to be elevated to increase the amount of fuel to be supplied from the main nozzle 54 to thereby facilitate the starting.

Hereinafter the structure, which forms the gist of the first preferred embodiment of the present invention, will be described. An upright wall 60 is provided at a site upstream of the reed valve 41 in the air supply passage 23 defined in the insulator 22 so as to project into the air supply passage 23. This upright wall 60 serves as a delay member for delaying the time required for the air A, then flowing within the air supply passage 23, to reach the first and second scavenging passages 30 and 31 and is disposed at a site in the vicinity of an upstream side of the reed valve 41 and adjacent a tip end portion 41*a* of the reed valve 41 in a transverse section of the air supply passage 23 so as to extend along a plane substantially perpendicular to the direction of flow of the air A within the air supply passage 23, that is, a plane substantially perpendicular to the longitudinal axis C1 of the air supply passage 23 to a heightwise position that is substantially equal to one half of the passage height of the air supply passage 23 as will be detailed later. At a site confronting a projecting end portion of the upright wall 60 in the air supply passage 23, a recess 61 forming a part of a flow path for the air A is formed and the details of this recess 61 will be described later.

At a site upstream of the upright wall 60 in the air supply passage 23, a cylindrical holding member 64 having a slightly greater inner diameter than the passage diameter of the carburetor air supply passage 48 is inserted, and the holding member 64 has a hollow which will serve as the air supply passage 23 having a slightly greater passage area than that of the carburetor air supply passage 48. A partition plate 63 is provided in this hollow of the holding member 64, and the widthwise direction (up and down direction as viewed in FIG. 2) of its rectangular shape extends parallel to the axis C3 of the rotary valve 28 and the lengthwise direction of the rectangular shape extends in a direction conforming to the direction of flow of the air A within the air supply passage 23. The holding member 64 and the partition plate 63 are formed in one piece construction as a partitioning unit. The inner diameter of the holding member 64 is greater than that of the carburetor air supply passage 48 by a quantity equal to the passage area that is narrowed by the presence of the partition plate 63 and, accordingly, the passage area of the air supply passage 23 is rendered to be equal to that in the conventional case with no partition plate 63 employed.

Figure 3A:
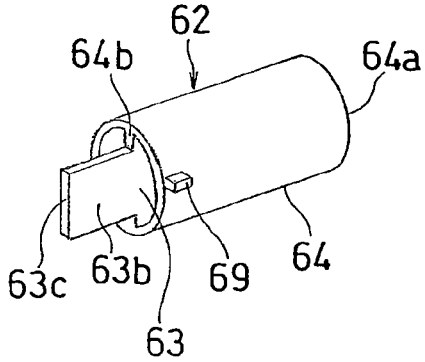
FIG. 3A is a schematic perspective view showing a partitioning unit employed in the two-stroke cycle engine shown in FIG. 1.
Figure 3B:
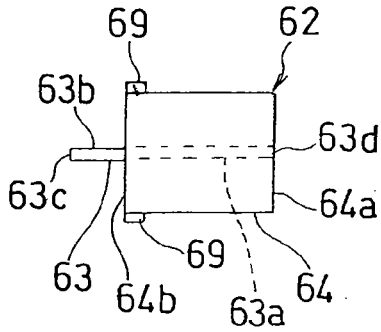
FIG. 3B is a top plan view showing the partitioning unit shown in FIG. 3A.
Figure 3C:
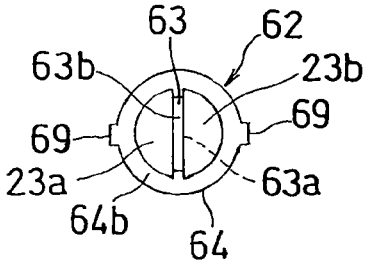
FIG. 3C is a left side view showing the partitioning unit shown in FIG. 3A.
Figure 3D:
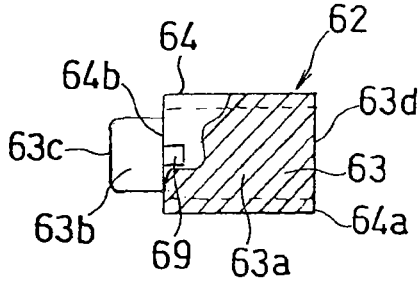
FIG. 3D is a schematic front elevational view showing, with a portion cut out, the partitioning unit shown in FIG. 3A.

FIG. 3A illustrates a schematic perspective view of the partitioning unit 62 employed in the two-stroke cycle engine, FIG. 3B illustrates a top plan view of the partitioning unit 62 shown, and FIG. 3C illustrates a left side view of the partitioning unit 62. Referring to FIG. 3C, the partitioning unit 62 is divided into two flow regions 23*a* and 23*b*, which have respective shapes symmetrical to each other and also have the same passage areas (transverse sectional area), by the flat partition plate 63 having the skewless in the hollow of the cylindrical holding member 64. The partition plate 63 includes a main body 63*a* extending over the entire length of the holding member 64, which body 63*a* is of one piece construction formed integrally with a partitioning projection 63*b*, that has a width (dimension in the up and down direction as viewed in FIGS. 3A to 3D) slightly smaller than that of the main body 63*a* and extends from the main body 63*a* in an upstream direction and having a width enough to accommodate the carburetor air supply passage 48 (best shown in FIG. 2) therein. Also, an outer surface of an upstream end portion of the holding member 64 is formed integrally with a positioning projection 69 at two locations that are opposed in a radial direction perpendicular to the partition plate 63. This partitioning unit 62 is of one piece construction prepared from a raw material such as nylon.

Figure 4A:
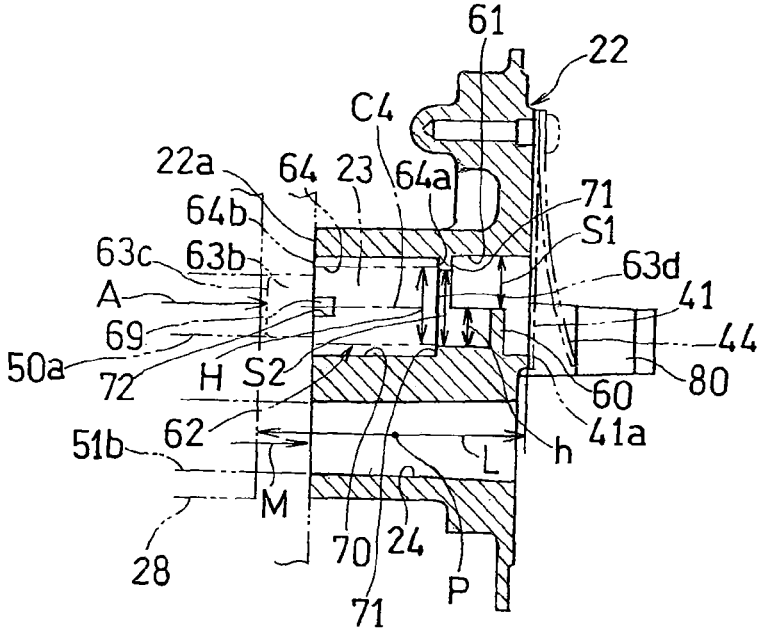
FIG. 4A is a front sectional view showing an insulator employed in the two-stroke cycle engine.
Figure 4B:
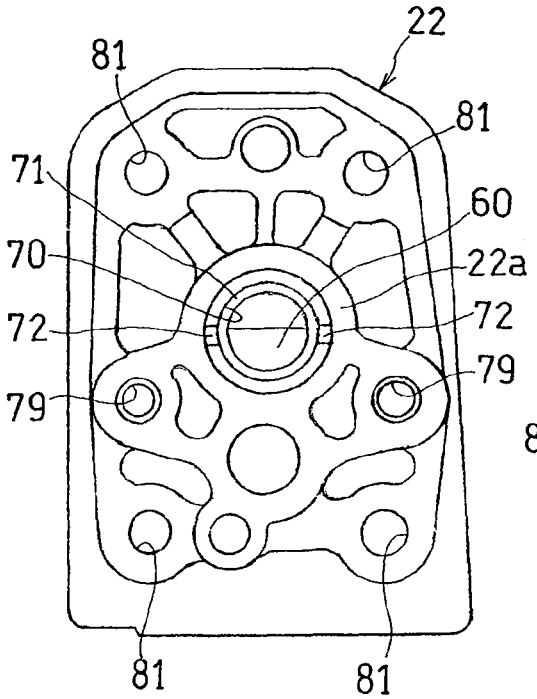
FIG. 4B is a left side view showing the insulator shown in FIG. 4A.
Figure 4C:
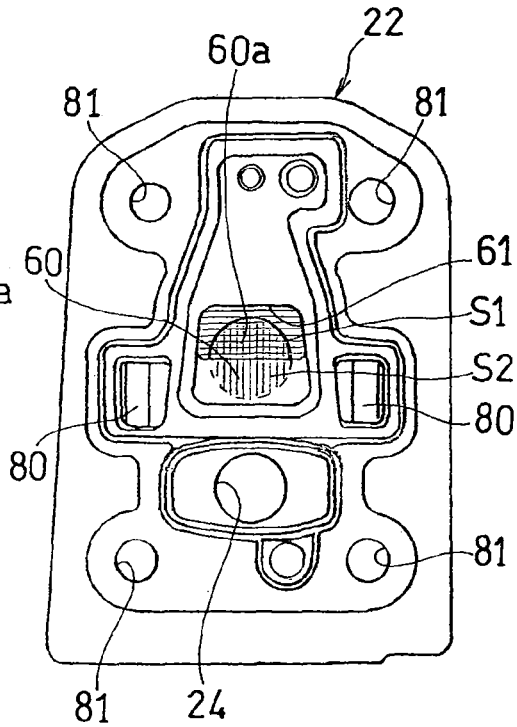
FIG. 4C is a right side view showing the insulator shown in FIG. 4A.

FIG. 4A illustrates a front sectional view of the insulator employed in the two-stroke cycle engine, FIG. 4B illustrates a left side view of the insulator, and FIG. 4C illustrates a right side view of the insulator. As shown in FIG. 4A, the insulator 22 is formed with a passage expanded portion 70 of a structure, in which the diameter of the passage is increased relative to the air supply passage in the existing insulator by the sum of a quantity, corresponding to the thickness of the cylindrical holding member 64 in the partitioning unit 62 as shown by the double dotted chain line, and a quantity corresponding to the transverse sectional area of the partition plate 63. With the holding member 64 of the partitioning unit 62 mounted coaxially inside the passage expanded portion 70, the air supply passage 23 having the same passage area as that of the existing air supply passage is formed by the hollow of the holding member 64 and the partition plate 63.

In the passage expanded portion 70 an upper half portion of a downstream end (right end as viewed in FIG. 4A) in a direction conforming to the direction of flow of air is formed with a cylindrical step 71 having the same inner diameter as that of the cylindrical holding member 64. This cylindrical step 71 is held in abutment with a downstream end face 64*a* of the holding member 64 of the partitioning unit 62 inserted into the passage expanded portion 70 to position the holding member 64 so that an upstream end face 64*b* of the holding member 64 may be held in flush with the mating surface 22*a* with the carburetor 3 in the insulator 22.

Also, a downstream side of the direction of flow of the air A from the passage expanded portion 70 in the insulator 22 has a lower half portion of the passage continued to the cylindrical step 71, which has the same inner diameter as that of the cylindrical step 71 and extends to the upright wall 60. Accordingly, the passage lower half portion is provided with an air supply passage of the same diameter as that of the air supply passage 23 comprised of the hollow of the holding member 64 in the partitioning unit 62 and, at a site adjacent the reed valve 41 in this air supply passage, the upright wall 60 is formed integrally. This upright wall 60 is disposed adjacent the tip end portion 41*a* of the reed valve 41 and extends towards a surface perpendicular to the direction of flow of the air A in the air supply passage 23, that is, an axis C4.

Also, the insulator 22 has the recess 61 referred to previously, which recess 61 is formed at a site from the cylindrical step 71 in the passage upper half portion confronting a projected end portion 60*a* of the upright wall 60 to a downstream end. This recess 61 is, as shown by transverse parallel lines in FIG. 4C, formed to a have a substantially square transverse sectional shape and the passage area S1 at the site where the upright wall 60 exists is set to the substantially same value as the passage area on an upstream side in close vicinity of the upright wall 60, that is, the area S2 of the air supply passage 23 formed by the inner peripheral surface of the cylindrical step 71 and the hollow of the holding member 64 on the upstream side thereof as shown by vertical parallel lines.

As shown in FIG. 4B, at two sites of the passage expanded portion 70 in the upstream end portion of the insulator 22, which confront with each other in a radially horizontal direction, a pair of recesses 72 are formed. In those recesses 72, a pair of the positioning projections 69 of the partitioning unit 62 shown in FIGS. 3A to 3D are engaged. Those recesses 72, when the holding member 64 of the partitioning unit 62 is engaged in the passage expanded portion 70 as shown in FIG. 4A, serve to prevent the holding member 64 from rotating through the positioning projections 69.

To the insulator 22 to which the partitioning unit 62 is fitted in the manner described above, the carburetor 3 and the air cleaner unit 4, both referred to previously, are fitted as shown in FIG. 5. In other words, in a condition in which a partitioning projection 63*b* of the partitioning unit 62 engaged in the insulator 22 is advanced into the carburetor air supply passage 48 and the mating surface 22*a* is held in contact with a downstream end face of the carburetor 3 and the air cleaner unit 4 is held in contact with an upstream end face of the carburetor 3, bolts 78 inserted through insertion holes 73 and 74 defined respectively in the air cleaner unit 4 and the carburetor 3 are threaded into a pair of threaded holes 79 in the insulator 22 to secure the carburetor 3 and the air cleaner unit 4 to the insulator 22, thereby completing an intake system assembly. At this time, the partitioning unit 62 is such that the upstream end face 64*b* of the holding member 64 is held in contact with the downstream end face of the carburetor 3, and, therefore, is held in position inseparable from the insulator 22.

Also, the insulator 22 is such that a projecting piece 80 provided at a lower end portion thereof is advanced into the cylinder block 1 to thereby form a part of an upstream side of the air introducing passage 40. Under this condition, the insulator 22 is secured to the cylinder block 1 by threading bolts (not shown), inserted through four mounting holes 81 shown in FIG. 4B, into corresponding threaded holes (not shown) in the cylinder block 1.

Although the insulator 22 referred to above is formed of a raw material capable of providing a high thermal insulating effect, such as, for example, a phenol resin, it is difficult to form the thin partition plate 63, shown in FIG. 2, in one piece construction since the phenol resin is hard and fragile. In contrast thereto, in the two-stoke cycle engine of the type discussed hereinabove, the partitioning unit 62 made up of the partition plate 63 and the holding member 64 is formed by molding nylon, which is a robust raw material easy to be processed. With this partitioning unit 62 engaged in the passage expanded portion 70 of the insulator 22, it is possible to rigidly fit the partition plate 63 to the inside of the air supply passage 23 made up of the hollow in the holding member 64.

In the preferred embodiment now under discussion, while an improvement is made to the existing engine to have the passage expanded portion 70, the upright wall 60 and the recess 61 in the insulator 22 and the partitioning unit 62 of a separate member is merely engaged to the insulator 22, the increase of the rapid accelerating capability such as described below and the stability of rotation during the intermediate opening drive can be achieved.

During the idling, the air/fuel mixture supply valve body 51 is opened to a required opening to permit the air/fuel mixture M of a concentration optimum to the idling to be supplied into the combustion chamber 1*a* from the air/fuel mixture supply passage 24 through the scavenging passages 30 and 31. On the other hand, as shown in FIG. 5, the air supply valve body 50 maintains the fully closed condition of the air supply passage 23 to thereby suppress a fluctuation of the engine rotation resulting from a change in amount of air inflowing through the air supply passage 23. Accordingly, the idling with a stabilized rotation can be performed.

Figure 7:
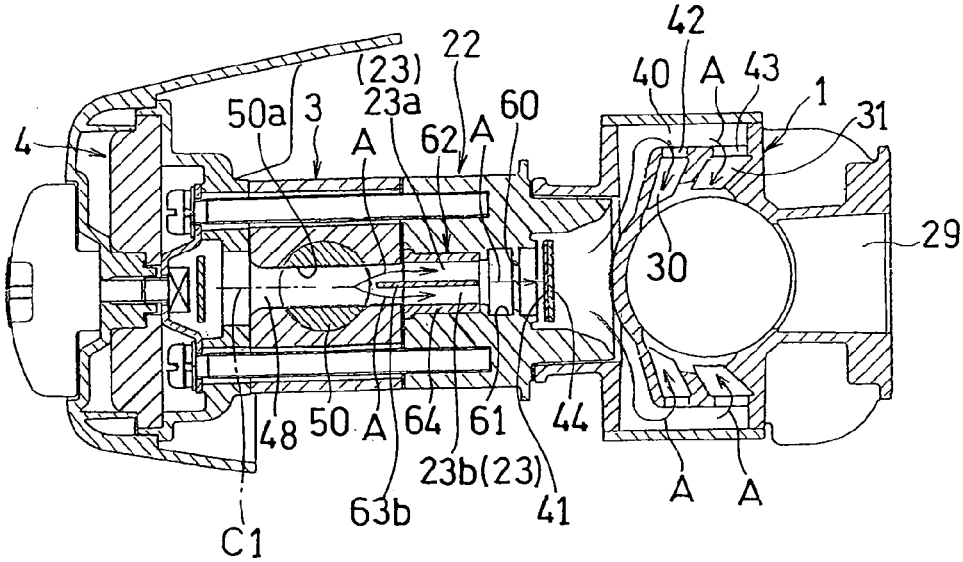
FIG. 7 is a transverse sectional view showing a fully opened drive condition of the air intake system of the two-stroke cycle engine as viewed from top.

Then the operation for the rapid acceleration is performed from the idling condition, as shown in FIG. 7, the air supply valve body 50 fully opens the air supply passage 23 to allow a large amount of air A from the air supply passage hole 50*a* in the air supply valve body 50 to flow into the air supply passage 23 then empty during the idling. The flow velocity of this air A, however, is decelerated as the direction of flow thereof over the upright wall 60 along the plane substantially perpendicular to the axis C1 of the air supply passage 23 is changed and, at the same time, the flow path from the scavenging passages 30 and 31 to the air supply valve body 50 is increased owning to the presence of the upright wall 60. Accordingly, the timing, at which the air A having passed through the air supply passage 23 flows into the scavenging passages 30 and 31, is delayed and hence approaches to the point at which the air/fuel mixture M flows from the air/fuel mixture supply passage 24 into the scavenging passages 30 and 31 through the crank chamber 2*a*.

As a result, the air/fuel mixture M entering from the scavenging passages 30 and 31 into the combustion chamber 1*a* is prevented from being excessively leaned by the air A, accompanied by reduction of the possibility of occurrence of the failure to accelerate and/or the failure of the engine to rotate, and, therefore, it is possible to achieve a smooth and rapid acceleration. Also, although the upright wall 60 disturbs the air flow to increase the flow resistance, the increase of the flow resistance can be suppressed as much as possible since it is disposed at a location closer to the reed valve 41, positioned downstream of the rotary valve 28, than to the position intermediate between the rotary valve 28 and the reed valve 41.

Considering that the upright wall 60 is disposed at a location in the vicinity of the reed valve 41 as shown in FIG. 1 and adjacent the tip end portion 41*a* of the reed valve 41 in the transverse sectional plane of the air supply passage 23, an undesirable direct impingement of the air A upon the tip end portion 41*a* of the reed valve 41, where the highest valve opening pressure acts, is prevented. Therefore, the timing at which the reed valve 41 is opened by the flowing air A is delayed, wherefore the air A flowing through the air supply passage 23 can further delay the timing at which it reaches the scavenging passages 30 and 31.

In addition, since the main body 63*a* and the partition projecting piece 63*b* of the partition plate 63 shown in FIG. 3A extend in a direction conforming to the direction of flow of the air supply passage 23 shown in FIG. 2 and front edges thereof extend parallel to the axis C3 of the rotary valve 28, the air A impinges upon the front edge of the partition projecting piece 63*b* of the partition plate 63 when the rotary valve 28 is fully opened, accompanied by the reduction in flow velocity. Accordingly, again the timing at which the air A flows into the scavenging passages 30 and 31 is delayed.

Further, since the passage area at the site where the upright wall 60 exists is set by the substantially square shaped recess 61 to the substantially same value as the passage area of the air supply passage 23 on the immediately upstream side, an undesirable increase of the flow resistance, which would be brought about by the reduction in passage area at the site of the upright wall 60, can be suppressed. As a result, despite that the deceleration is made by altering the direction of flow of the air A by means of the upright wall 60 and the recess 61, the required amount of the air A can be smoothly supplied from the scavenging passages 30 and 31 into the combustion chamber 1*a* to enable the stabilized rotation.

Also, by setting the passage area in the way as described above, the increase of the flow resistance brought about by the upright wall 60 can be suppressed, but, at this time, as shown in FIG. 4C, with the recess 61 having been so shaped as to represent the substantially square shape, the height and the width of the flow path having the required passage area can be undersized as compared with the case in which the circular shape is chosen. Therefore, the recess 61 can be easily provided in the limited space available around the air supply passage 23.

Where the throttle is gradually opened from the idling condition, as shown in FIG. 6, the air supply passage hole 50*a* of the air supply valve body 50 gradually opens largely to communicate relative to the air supply passage 23 on the downstream side thereof. Accordingly, in the case where no partition plate 63 is employed, the air supply passage 23 abruptly enlarges at a site downstream of the air supply passage hole 50*a* until the medium opening of the valve body 50 and, therefore, a strong turbulent flow tends to occur at that portion. At this time, due to the use of the partition plate 63, since up until the medium opening (medium load), the air supply passage hole 50*a* communicates with only one flow region 23*a* partitioned by the partition plate 53, the abrupt enlargement of the air supply passage 23 is substantially suppressed. As a result, it is possible to prevent the possible fluctuation in rotation due to an occurrence of a strong turbulent flow in the air A after an entrance of the air A from the air supply passage hole 50*a* of the rotary valve 28 into the passage region 23*a* of the air supply passage 23, and, the stability of the rotation is therefore increased.

When the valve body 50 attains the medium opening, the outlet area of the air supply passage hole 50*a* of the air supply valve body 50 becomes equal to the opening area of the flow region 23*a* of the air supply passage 23 partitioned by the partition plate 63 and, therefore, no portion is left, in which the air A in the flow region 23*a* of the air supply passage 23 does not almost flow, or a considerable unevenness in flow distribution occurs. As a result, the air A flowing into the flow region 23*a* of the air supply passage 23 is sufficiently rectified and no turbulent flow occur therein.

In a condition in which the air supply valve body 50 is fully opened, as shown in FIG. 7, the outlet opening in its entirety of the air supply passage hole 50*a* is communicated with the air supply passage 23 on the side downstream thereof and no abrupt enlargement of the passage area occurs between the air supply passage hole 50*a* and the outlet. Therefore, the air A smoothly flows in both of the first flow region 23*a* and the second flow region 23*b*, which are so divided by the partition plate 63, resulting in that no strong turbulent flow is caused to occur within the air supply passage 23.

In order to obtain the effect of the rapid accelerating capability as hereinabove described, as shown in FIG. 4A, it is preferred that the height h of the upright wall 60 is set to a value which is 0.3 to 0.5 times the passage height H of the air supply passage 23 (the passage diameter in the case of the circular passage). Also, in order to obtain the increase of the stability in rotation at the medium opening as described above, it is preferred that the partition plate 63 is elongated and brought close to the air supply passage hole 50*a* of the air supply valve body 50 so that the upstream end edge 63*c* of the partition plate 63 may match with the outlet of the air supply passage hole 50*a* and, at the same time, a downstream end edge 63*d* is disposed at a position closer to the reed valve 41 than to the intermediate point P of the distance L between the reed valve 41 and the outlet of the air supply passage hole 50*a*.

Figure 8:
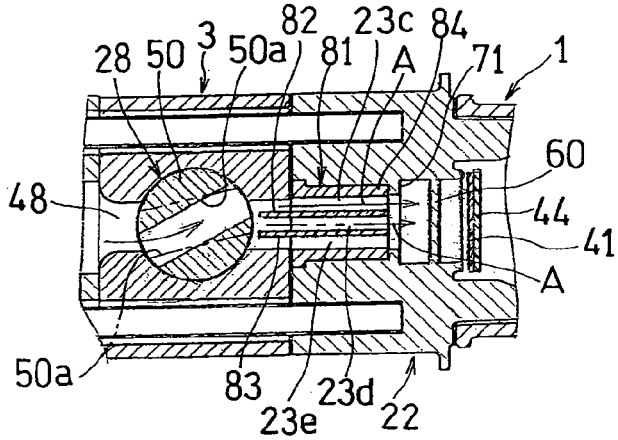
FIG. 8 is a fragmentary transverse sectional view showing an important portion of the two-stroke cycle engine of the stratified scavenging type designed in accordance with a second preferred embodiment of the present invention as viewed from top.

FIG. 8 illustrates a fragmentary transverse sectional view of an important portion of the two-stroke cycle engine designed in accordance with a second preferred embodiment of the present invention and it can be suitably applied to a large sized two-stroke cycle engine. In other words, where the flow amount of the air A to be supplied is large, a partitioning unit 81 is structured in one piece construction with two parallel partition plates 82 and 83 formed integrally within the hollow of a cylindrical holding member 84. By so doing, as shown by the solid line, at a low opening in which the opening area of the air supply passage hole 50*a* is small, the air A is caused to flow in only a first flow region 23*c* divided by the first partition plate 82 closest to the outlet of the air supply passage hole 50*a*.

As shown by the double dotted line, at the middle opening of the air supply valve body 50, since the end edge of the outlet of the air supply passage hole 50*a* confronts the second partition plate 83, the air A flows into not only the first flow region 23*c*, but also the second flow region 23*d* defined between the first partition plate 82 and the second partition plate 83. Accordingly, in the large sized two-stroke cycle engine of a type in which the amount of flow of the air A is large, it is possible to avoid the occurrence of the turbulent flow of the air A within the air supply passage 23 during the drive with the opening smaller than the medium opening and, therefore, the stability of the rotation can be increased. At the full opening of the air supply valve body 50, the air A flows further into a third flow region 23*e* thereby to assure smooth flow of large amount of the air A.

Figure 9:
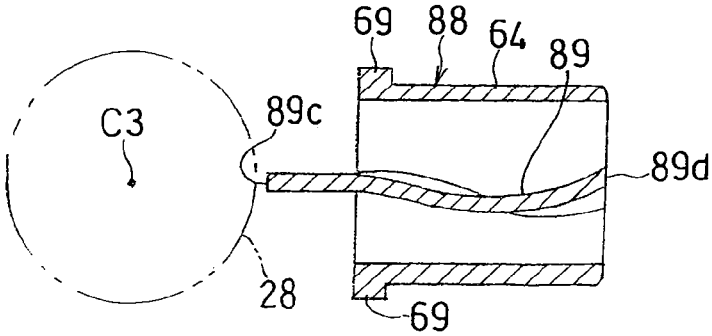
FIG. 9 is a fragmentary transverse sectional view showing the partitioning unit used in the two-stroke cycle engine of the stratified scavenging type designed in accordance with the second preferred embodiment of the present invention as viewed from top.

FIG. 9 illustrates the partitioning unit used in the two-stroke cycle engine designed in accordance with a third preferred embodiment of the present invention. The partitioning unit now identified by 88 is such that a front edge 89*c* of the partition plate 89 if of a shape extending parallel to the axis C3 of the rotary valve 28 and, over the entire length, or a part of such entire length, from the front edge 89*c* to a rear edge 89*d*, it is twisted about an axis of the partition plate 89, that is, about the axis of the cylindrical holding member 64. In a manner similar to that in the previously described first embodiment of the present invention, this partitioning unit 88 is effective to rectify the air A with the partition plate 89 at the opening smaller than the medium opening and, hence, avoid the occurrence of the turbulent flow and, in the event of the rapid acceleration from the idling condition, the air A flows along the partition plate 89 of the twisted shape to further decelerate the flow velocity of the air A, thereby increasing the rapid accelerating capability. A similar twisting may be applied to the first and second partition plates 83 and 93 employed in the practice of the second embodiment of the present invention shown in and described with reference to FIG. 8.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

REFERENCE NUMERALS

1*a*: Combustion chamber
23: Air supply passage
24: Air/fuel mixture supply passage
28: Rotary valve
31, 32: Scavenging passage
41: Reed valve (Check valve)
50: Air supply valve body
51: Air/fuel mixture supply valve body
60: Upright wall (Delay member)
60*a*: Projected end portion of the upright wall
61: Recess
62, 81, 88: Partitioning unit
63, 82, 83, 89: Partition plate (Delay member)
64: Holding member
A: Air
M: Air/fuel mixture

What is claimed is:

1. A two-stroke cycle engine of a stratified scavenging type, in which an air/fuel mixture and an air are introduced from a scavenging passage into a combustion chamber, which engine comprises:

a valve body for adjusting a first opening of an air supply passage, through which the air is supplied to the scavenging passage, and a second opening of an air/fuel mixture supply passage, through which the air/fuel mixture is supplied to the scavenging passage;

a check valve for preventing the air within the air supply passage from flowing in a reverse direction; and a delay member is an upright wall having a substantially square transverse sectional shape, and the upright wall is fixed in the air supply passage to project into one half of the passage height of the air supply passage on an upstream side of the check valve for delaying the timing at which the air reaches from the valve body to the air scavenging passage.

2. The two-stroke cycle engine as claimed in claim 1, in which the upright wall extends along a plane substantially perpendicular to a direction of flow of the air supply passage.

3. The two-stroke cycle engine as claimed in claim 2, in which the upright wall is provided at a location adjacent the check valve and remote from a position intermediate between the valve body and the check valve.

4. The two-stroke cycle engine as claimed in claim 2, in which a recess forming a part of a flow path for the air is formed at a site confronting a projecting end portion of the upright wall in the air supply passage.

5. The two-stroke cycle engine as claimed in claim 4, in which the recess is of a substantially square shape in its transverse sectional shape and the passage area at a site, where the upright wall exists, is chosen to be the substantially the same as the passage area on an upstream side in a close vicinity of the upright wall.

6. The two-stroke cycle engine as claimed in claim 2, in which the check valve comprises a reed valve and the upright wall is disposed at a location adjacent a tip end portion of the reed valve in a transverse section of the air supply passage.

7. The two-stroke cycle engine as claimed in claim 1, in which the valve body is a rotary valve of a type, in which a radially extending passage hole is formed in a cylindrical column, and the delay member further comprises a partition plate having a front edge, which extends parallel to an axis of the rotary valve, and extending in a direction conforming to the flow direction of the air supply passage.

8. The two-stroke cycle engine as claimed in claim 7, in which the partition plate extends from an outlet of the rotary valve to a location downstream of an intermediate position between the outlet and the check valve.

9. The two-stroke cycle engine as claimed in claim 7, in which a portioning unit comprising the partition plate and a cylindrical holding member is substantially coaxially engaged in the air supply passage and the partition plate is formed integrally with the holding member and traverses a hollow of the holding member.

10. A two-stroke cycle engine of a stratified scavenging type, in which an air/fuel mixture and an air are introduced from a scavenging passage into a combustion chamber, which engine comprises:

a valve body for adjusting a first opening of an air supply passage, through which the air is supplied to the scavenging passage, and a second opening of an air/fuel mixture supply passage, through which the air/fuel mixture is supplied to the scavenging passage;

a check valve for preventing the air within the air supply passage from flowing in a reverse direction; and a plurality of delay members are positioned in the air supply passage on an upstream side of the check valve for delaying the timing at which the air reaches from the valve body to the air scavenging passage, wherein the valve body is a rotary valve of a type in which a radially extending passage hole is formed in a cylindrical column, and a first delay member, of the plurality of delay members, comprises a partition plate having a front edge, which extends parallel to an axis of the rotary valve, and in a direction conforming to the flow direction of the air supply passage, to divide the air supply passage into separate air flow passages, the partition plate is configured to receive the air directly from the rotary valve, and a second delay member, of the plurality of delay members, is a fixed upright wall extending into the air supply passageway along a plane substantially perpendicular to a direction of flow of the air supply passage to close approximately one half of the height of the air supply passage adjacent the check valve wherein the partition plate directs air towards the second delay member.

11. The two-stroke cycle engine as claimed in claim 10, in which the partition plate extends from an outlet of the rotary valve to a location downstream of an intermediate position between the outlet and the check valve.

12. The two-stroke cycle engine as claimed in claim 10, in which the first delay member includes the partition plate and a cylindrical holding member that is substantially coaxially engaged in the air supply passage and the partition plate is formed integrally with the cylindrical holding member and traverses a hollow opening of the holding member to provide the separate air flow passages.

13. The two-stroke cycle engine as claimed in claim 12 wherein the first delay member is molded of Nylon.

* * * * *